US006453625B1

(12) United States Patent
Corbett

(10) Patent No.: US 6,453,625 B1
(45) Date of Patent: Sep. 24, 2002

(54) INSULATED BUILDING BLOCK

(76) Inventor: Jeffrey M. Corbett, 2729 Evergreen Ave., Saint Croix Falls, WI (US) 54024

( * ) Notice: Subject to any disclaimer, the term of this patent is extended or adjusted under 35 U.S.C. 154(b) by 0 days.

(21) Appl. No.: 09/899,979

(22) Filed: Jul. 6, 2001

(51) Int. Cl.[7] ..... E04C 1/40
(52) U.S. Cl. ..... 52/125.3; 52/405.1; 52/606
(58) Field of Search ..... 52/405.1, 405.2, 52/405.3, 405.4, 606, 309.12, 309.17, 125.2, 125.3

(56) References Cited

U.S. PATENT DOCUMENTS

| | | | | | |
|---|---|---|---|---|---|
| 541,815 | A | * | 6/1895 | Lee, Sr. | 52/606 |
| 1,529,317 | A | * | 3/1925 | Ludeman | 52/125.3 |
| 1,567,430 | A | * | 12/1925 | Eberling | 52/125.3 |
| 1,887,701 | A | * | 11/1932 | Stevens | 52/125.3 |
| 2,319,203 | A | * | 5/1943 | Branham | 52/606 |
| 3,209,510 | A | | 10/1965 | Nakanishi | |
| 3,416,281 | A | | 12/1968 | Kopp | |
| 3,780,484 | A | | 12/1973 | Muse | |
| D264,996 | S | | 6/1982 | Siedschlag | |

FOREIGN PATENT DOCUMENTS

| | | | | |
|---|---|---|---|---|
| DE | 3100642 | * | 12/1981 | 52/405.2 |
| FR | 677668 | * | 3/1930 | 52/606 |

* cited by examiner

*Primary Examiner*—Michael Safavi

(57) ABSTRACT

A insulated building block for providing insulation to a structure. The insulated building block includes a member has top and bottom faces, and front and back faces. The member has a spaced apart pair of insulation spaces extending therethrough between the top and bottom faces of the member. The member has at least one vent space extending therethrough between the top and bottom faces of the member. The vent space is interposed between the insulating spaces and the front face of the member.

20 Claims, 4 Drawing Sheets

INSULATED BUILDING BLOCK

REFERENCE TO RELATED APPLICATION

This application is a substitute for application Ser. No. 09/314,902, filed May 20, 1999.

BACKGROUND OF THE INVENTION

1. Field of the Invention

The present invention relates to insulated building blocks and more particularly pertains to a new insulated building block for providing insulation to a structure.

2. Description of the Prior Art

The use of insulated building blocks is known in the prior art. More specifically, insulated building blocks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,416,281; U.S. Pat. No. 3,209,510; U.S. Pat. No. Des. 264,996; U.S. Pat. No. 3,780,484; U.S. Pat. No. 3,442,058; and U.S. Pat. No. 2,319,203.

While these devices fulfill their respective, particular objectives and requirements, the aforementioned patents do not disclose a new insulated building block. The inventive device includes a member has top and bottom faces, and front and back faces. The member has a spaced apart pair of insulation spaces extending therethrough between the top and bottom faces of the member. The member has at least one vent space extending therethrough between the top and bottom faces of the member. The vent space is interposed between the insulating spaces and the front face of the member.

In these respects, the insulated building block according to the present invention substantially departs from the conventional concepts and designs of the prior art, and in so doing provides an apparatus primarily developed for the purpose of providing insulation to a structure.

SUMMARY OF THE INVENTION

In view of the foregoing disadvantages inherent in the known types of insulated building blocks now present in the prior art, the present invention provides a new insulated building block construction wherein the same can be utilized for providing insulation to a structure.

The general purpose of the present invention, which will be described subsequently in greater detail, is to provide a new insulated building block apparatus and method which has many of the advantages of the insulated building blocks mentioned heretofore and many novel features that result in a new insulated building block which is not anticipated, rendered obvious, suggested, or even implied by any of the prior art insulated building blocks, either alone or in any combination thereof.

To attain this, the present invention generally comprises a member has top and bottom faces, and front and back faces. The member has a spaced apart pair of insulation spaces extending therethrough between the top and bottom faces of the member. The member has at least one vent space extending therethrough between the top and bottom faces of the member. The vent space is interposed between the insulating spaces and the front face of the member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new insulated building block apparatus and method which has many of the advantages of the insulated building blocks mentioned heretofore and many novel features that result in a new insulated building block which is not anticipated, rendered obvious, suggested, or even implied by any of the prior art insulated building blocks, either alone or in any combination thereof.

It is another object of the present invention to provide a new insulated building block which may be easily and efficiently manufactured and marketed.

It is a further object of the present invention to provide a new insulated building block which is of a durable and reliable construction.

An even further object of the present invention is to provide a new insulated building block which is susceptible of a low cost of manufacture with regard to both materials and labor, and which accordingly is then susceptible of low prices of sale to the consuming public, thereby making such insulated building block economically available to the buying public.

Still yet another object of the present invention is to provide a new insulated building block which provides in the apparatuses and methods of the prior art some of the advantages thereof, while simultaneously overcoming some of the disadvantages normally associated therewith.

Still another object of the present invention is to provide a new insulated building block for providing insulation to a structure.

Yet another object of the present invention is to provide a new insulated building block which includes a member has top and bottom faces, and front and back faces. The member has a spaced apart pair of insulation spaces extending therethrough between the top and bottom faces of the member. The member has at least one vent space extending therethrough between the top and bottom faces of the member. The vent space is interposed between the insulating spaces and the front face of the member.

Still yet another object of the present invention is to provide a new insulated building block that is designed to collect and divert moisture entering the block before it reaches the insulating material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
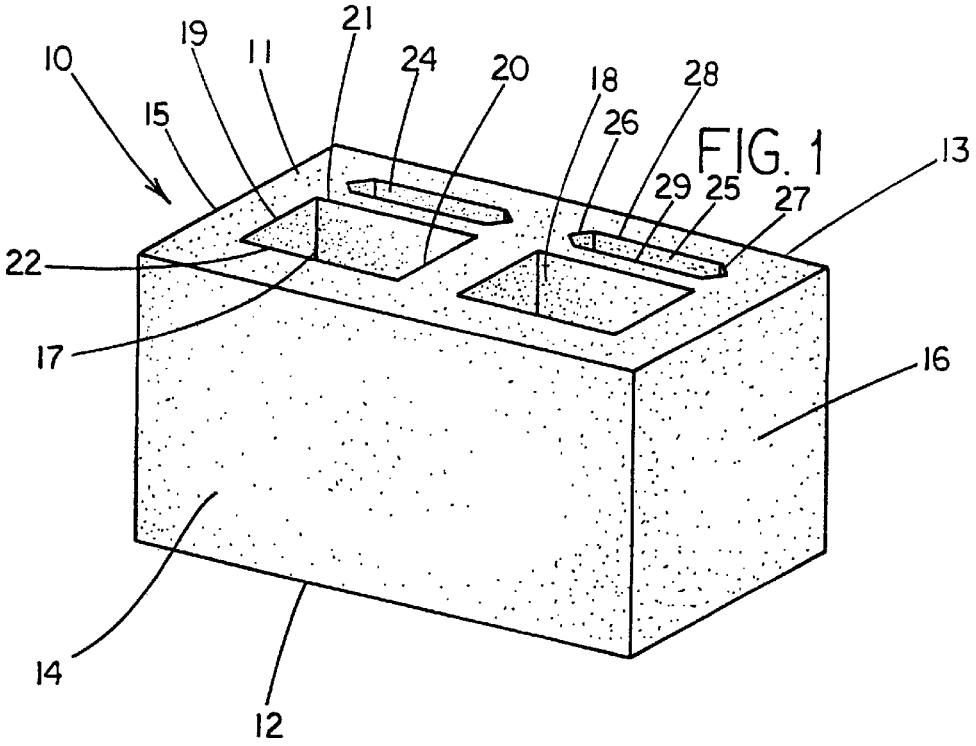
FIG. 1 is a schematic perspective view of a new insulated building block according to the present invention.
Figure 2:
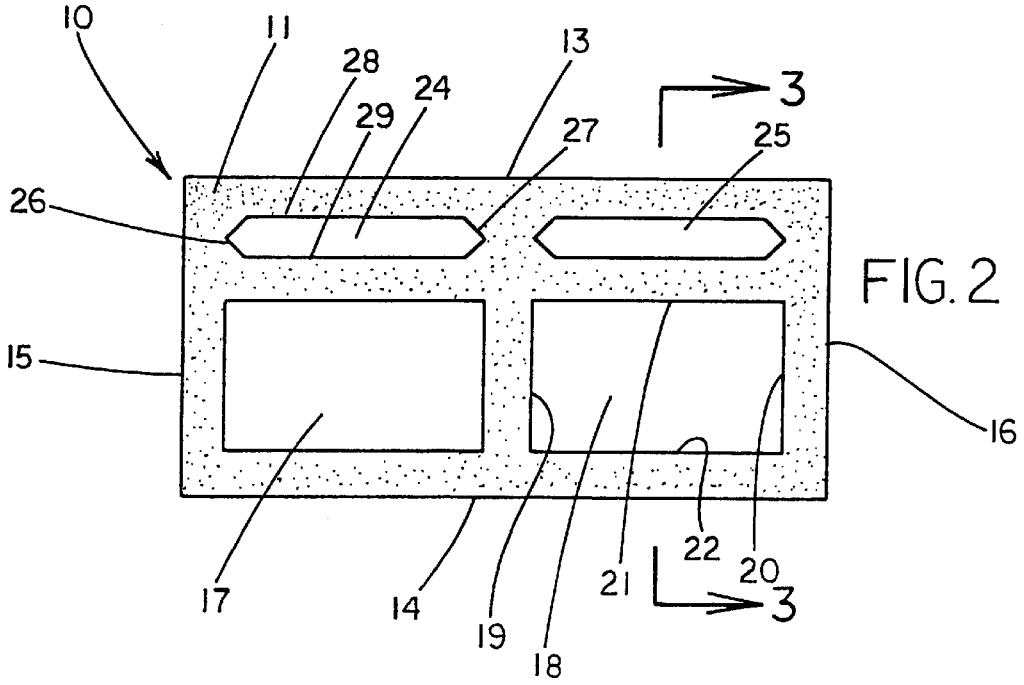
FIG. 2 is a schematic top view of the present invention.
Figure 3:
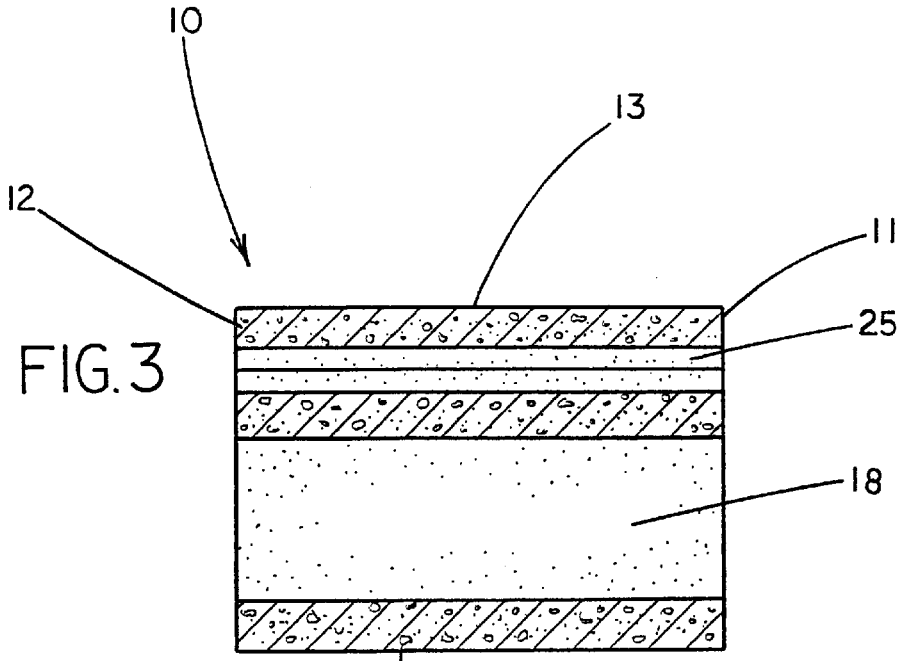
FIG. 3 is a schematic cross sectional view of the present invention taken from line 3—3 of FIG. 2.
Figure 4:
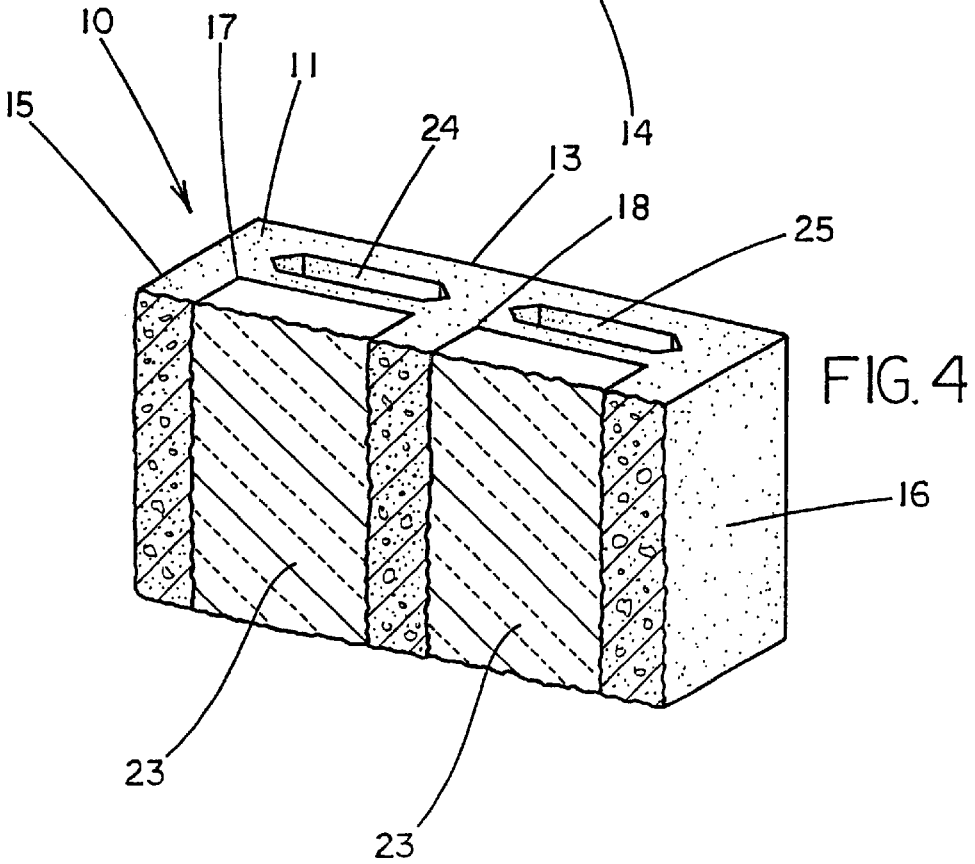
FIG. 4 is a schematic cross sectional view of the present invention with insulating material filling the insulating spaces of the member.
Figure 5:
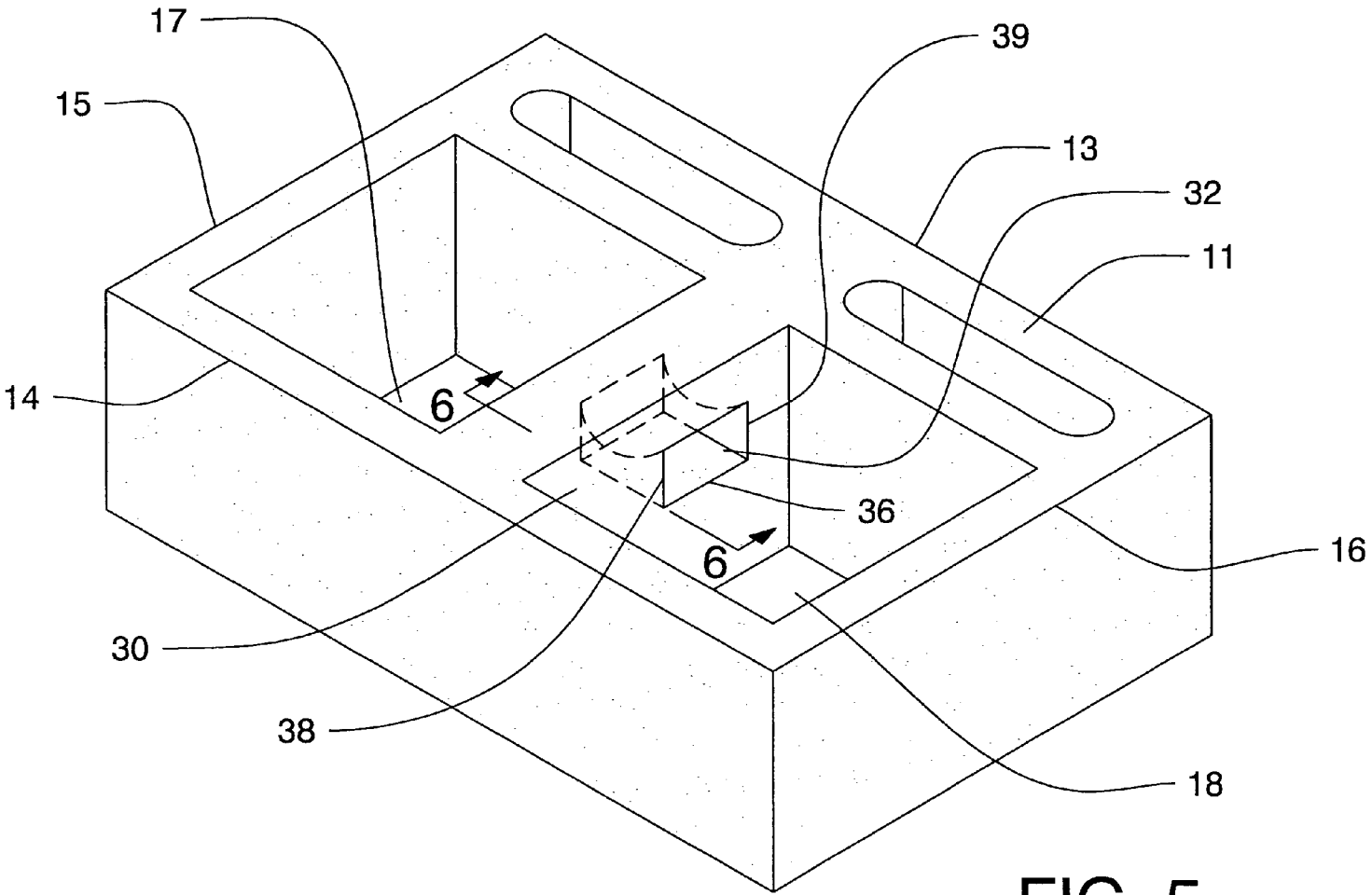
FIG. 5 is a schematic top perspective view of a block having an optional handle passage feature of the present invention.
Figure 6:
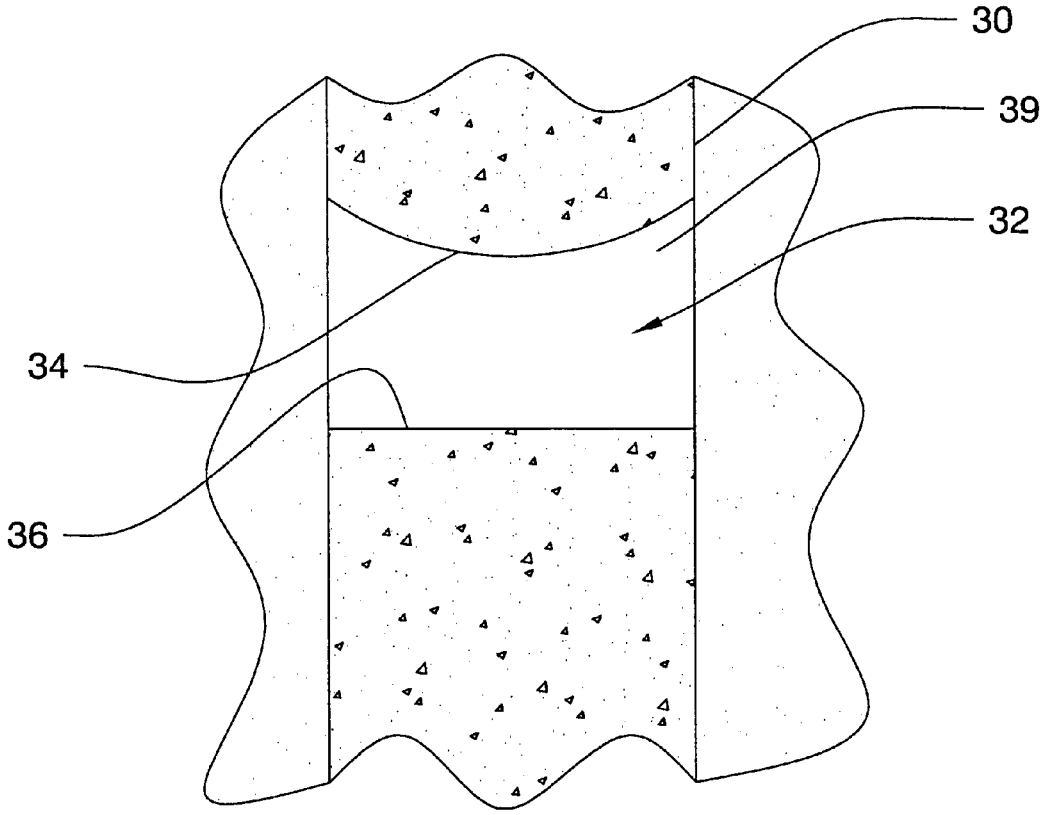
FIG. 6 is a schematic sectional view of a portion of the block taken along line 6—6 of FIG. 5 and particularly illustrating the handle passage.

With reference now to the drawings, and in particular to FIGS. 1 through 6 thereof, a new insulated building block embodying the principles and concepts of the present invention will be described.

As best illustrated in FIGS. 1 through 4, the insulated building block generally comprises a member has top and bottom faces, and front and back faces. The member has a spaced apart pair of insulation spaces extending therethrough between the top and bottom faces of the member. The member has at least one vent space extending therethrough between the top and bottom faces of the member. The vent space is interposed between the insulating spaces and the front face of the member.

In use, the insulating building block is designed for preventing moisture from passing therethrough and causing moisture from condensing into the interior of a structure constructed with a plurality of the building blocks. This structure also keeps moisture from passing through the block and condensing on the interior surface formed by the block. In closer detail, the insulating building block comprises a concrete member 10 having substantially parallel generally rectangular planar top and bottom faces 11, 12, substantially parallel generally rectangular planar front and back faces 13, 14 substantially perpendicular to the top and bottom faces of the block, and a pair of side faces 15, 16.

The member has a spaced apart pair of generally rectangular insulation spaces 17, 18 extending therethrough between the top and bottom faces of the member. Each of the insulation spaces has a pair of substantially parallel short sides 19, 20 and a pair of substantially parallel long sides 21, 22 extending substantially perpendicular to the short sides of the respective insulating space. The short sides of the insulation spaces are substantially parallel to the side faces of the member. The tong sides of the insulation spaces are substantially parallel to the front and back faces of the member.

Preferably, an insulating material 23 substantially fills each of the insulating spaces. The insulating material may comprise a loose file material such as fiberglass, rock wool, cellulose, vermiculite, and perlite, or a foamed material such as a foamed urethane or shredded foamed polystyrene that is blown or poured into the insulating spaces. The insulating material has a greater R-value (defined as a measure of the resistance to heat transfer through the particular material) than that the concrete material the member so that the insulating material has a greater resistance to the passage of heat therethrough than the concrete material of the member.

The member has at least one and preferably a pair of vent spaces 24, 25 extending therethrough between the top and bottom faces of the member. The vent spaces are interposed between the insulating spaces and the front face of the member for intercepting moisture movement from said front face of said member toward said insulation spaces in said member. In this structure, any moisture moving through the front face of the member reaches the vent spaces (and before reaching the insulating spaces), and is able to move downwardly through the vent space or to be evaporated in the vent space, and is not able to move through the gap of the vent space. Preferably, one of the vent spaces is positioned adjacent to one of the insulating spaces and the other of the vent spaces is positioned adjacent to the other of the insulating spaces. In an ideal embodiment, each of the vent spaces. is spaced apart about ½ inch from the associated adjacent insulating space.

The vent spaces and the insulation spaces each have a width measured in a direction extending substantially perpendicular to the front face of the member. The width of the insulating spaces should be greater than the width of the vent spaces for maximizing the space available in the member for receiving the insulating material, since the function of the vent space for carrying away any moisture moving through the front face of the member may be satisfactorily performed by vent spaces having a smaller width than the insulating spaces. Ideally, the width of the insulating spaces is greater than approximately two times the width of the vent spaces, and ratios of spaces of approximately four times or more are highly suitable.

Optionally, the vent spaces may each include a pair of generally V-shaped ends 26, 27 and substantially parallel front and back sides 28, 29 extending between the ends of the respective vent space. The front and back sides of the vent spaces may be substantially parallel to the front and back faces of the member. The front and back sides of each vent space are ideally spaced apart from one another about 1 inch.

A central divider wall 30 is formed between the pair of vent spaces 24, 25 and between the pair of insulation spaces 17, 18. The central divider wall extends between the front and back faces of the member. The central divider wall 30 may be positioned approximately halfway between the side faces 15, 16 of the member.

As a further option, a handle passage 32 (see FIGS. 5 and 6) is formed through the central divider wall 30. The handle passage 32 may extend between the insulation spaces 17, 18 of the member. The handle passage 32 has an upper surface 34 and a lower surface 36 and a pair of side surfaces 38, 39. The upper surface may have a convex shape toward the handle passage which can facilitate the insertion of fingers of a person, or other lifting means, into the handle passage. The handle passage may be located approximately halfway between the top face of the member and the bottom face of the member. Preferably, the handle passage is located approximately at a center of gravity or mass of the member to facilitate balancing of the member when the member is lifted by the handle passage.

In use, the member is designed for stacking with other members of the same construction to form a structure such that the bottom face of the member is rested on a top face of another member located therebelow and the bottom face of an additional member is rested on the top face of the first member and so on. Each vent space of each member of the stack is aligned with a corresponding vent space of the other members of the stack. Similarly, each insulating space of each member of the stack is aligned with a corresponding insulating space of the other members of the stack. The front face of the members of the stack are orientated to form the exterior surface of the structure is constructed with the blocks such that the vent spaces are positioned between the exterior surface of the structure and the insulating spaces. In use, moisture entering the members from the exterior surface of the formed structure (i.e., the front faces of the members) enters into the vent spaces where it accumulates either as condensation or frost. The vent spaces at the top and bottom of the stack are left open or are fluidly connected via conduits to a body of air to permit air flow from the top and bottom of the stack through the vent spaces and thereby remove the collected moisture from the vent spaces with the air circulating through the vent spaces. Drain holes also may be included fluidly connected to the vent spaces at the bottom of the stack to let moisture in the vent spaces flow out of the stack via the drain holes. This venting structure prevents moisture from reaching into the insulating spaces and thus keeps the insulating material in the insulating spaces free from moisture so that insulating material remains dry to provide an optimal amount of insulation to the member. Even without the insulating material, this block will increase the insulating property of the block when compared to a traditional block because the vent spaces keep moisture from passing through the entire member and the insulating spaces.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to, falling within the scope of the invention.

I claim:

1. An insulating building block, comprising:

a member having top and bottom faces, and front and back faces;

said member having a spaced apart pair of insulation spaces for receiving insulation material, said insulation spaces extending through said member between said top and bottom faces of said member; and said member having at least one vent space extending therethrough between said top and bottom faces of said member, said vent space being interposed between said insulating spaces and said front face of said member;

wherein said at least one vent space and said insulation spaces each have a width measured in a direction extending substantially perpendicular to said front face of said member, said width of said insulating spaces being greater than said width of said vent spaces for maximizing space available for receiving the insulating material;

wherein said vent space comprises a pair of generally V-shaped ends and substantially parallel front and back sides extending between said ends of said vent space.

2. The insulating building block of claim 1 wherein a central divider wall is formed between said pair of insulation spaces.

3. The insulating building block of claim 2 wherein said central divider wall is positioned approximately halfway between side faces of said member.

4. The insulating building block of claim 2 wherein a handle passage is formed through said central divider wall.

5. The insulating building block of claim 4 wherein said handle passage extends between. said insulation spaces of said member.

6. The insulating building block of claim 4 wherein said handle passage is defined by an upper surface, a lower surface, and a pair of side surfaces, said upper surface having a convex shape toward said handle passage.

7. The insulating building block of claim 4 wherein said handle passage is located approximately halfway between said top and bottom faces of said member.

8. The insulating building block of claim 1 wherein said width of said insulating spaces is greater than approximately two times said width of said at least one vent space.

9. The insulating building block of claim 1, wherein said top and bottom faces are substantially parallel to one another, and wherein said front and back faces are substantially parallel to one another and substantially perpendicular to said top and bottom faces.

10. The insulating building block of claim 1, wherein each of said insulation spaces has a pair of substantially parallel short sides and a pair of substantially parallel long sides extending substantially perpendicular to said short sides of the respective insulating space.

11. The insulating building block of claim 1, wherein an insulating material substantially fills each of said insulating spaces.

12. The insulating building block of claim 1, wherein said member has two vent spaces, one of said vent spaces being positioned adjacent one of said insulating spaces and the other of said vent spaces being positioned adjacent the other of said insulating spaces.

13. An insulating building block system, comprising:

a member having substantially parallel generally rectangular planar top and bottom faces, substantially parallel generally rectangular planar front and back faces substantially perpendicular to said top and bottom faces of said block, and a pair of substantially parallel generally rectangular planar side faces substantially perpendicular to said top, bottom, front and back faces of said member;

said member having a spaced apart pair of generally rectangular insulation spaces extending therethrough between said top and bottom faces of said member;

each of said insulation spaces having a pair of substantially parallel short sides and a pair of substantially parallel long sides extending substantially perpendicular to said short sides of the respective insulating space;

said short sides of said insulation spaces being substantially parallel to said side faces of said member;

said long sides of said insulation spaces being substantially parallel to said front and back faces of said member;

an insulating material substantially filling each of said insulating spaces, said insulating material being selected from the group consisting of fiberglass, rock wool, cellulose, vermiculite, perlite, foamed urethane or shredded foamed polystyrene;

said member having a spaced apart pair of vent spaces extending therethrough between said top and bottom faces of said member, said vent spaces being interposed between said insulating spaces and said front face of said member for intercepting moisture movement from said front face of said member toward said insulation spaces in said member, one of said vent spaces being positioned adjacent to one of said insulating spaces and the other of said vent spaces being positioned adjacent the other of said insulating spaces;

wherein a central divider wall is formed between said pair of vent spaces and between said pair of insulation spaces, said central divider wall extending between said front and back faces of said member, said central divider wall being positioned approximately halfway between said side faces of said member;

wherein a handle passage is formed through said central divider wall, said handle passage extending between said insulation spaces of said member, said handle passage having an upper surface and a lower surface and a pair of side surfaces, said upper surface having a convex shape toward said handle passage, said handle passage being located approximately halfway between said top and bottom faces of said member;

wherein each of said vent spaces is spaced about ½ inch from said adjacent insulating space;

said vent spaces each including a pair of generally V-shaped ends and substantially parallel front and back sides extending between said ends of the respective vent space;

said front and back sides of said vent spaces being substantially parallel to said front and back faces of said member;

wherein said insulating material has an R-value greater than an R-value of air such that said R value of each of said insulating spaces is greater than an R-value of said vent spaces; and wherein said vent spaces and said insulation spaces each have a width measured in a direction extending substantially perpendicular to said front face of said member, said width of said insulating spaces being greater than said width of said vent spaces for maximizing space available for receiving said insulating material, said width of said insulating spaces being greater than approximately two times said width of said vent spaces.

14. An insulating building block, comprising:

a member having top and bottom faces, and front and back faces;

said member having a spaced apart pair of insulation spaces for receiving insulation material, said insulation spaces extending through said member between said top and bottom faces of said member; and said member having at least one vent space extending therethrough between said top and bottom faces of said member, said vent space being interposed between said insulating spaces and said front face of said member;

wherein said at least one vent space and said insulation spaces each have a width measured in a direction extending substantially perpendicular to said front face of said member, said width of said insulating spaces being greater than said width of said vent spaces for maximizing space available for receiving the insulating material;

wherein a central divider wall is formed between said pair of insulation spaces;

wherein a handle passage is formed through said central divider wall; and wherein said handle passage is defined by an upper surface, a lower surface, and a pair of side surfaces, said upper surface having a convex shape toward said handle passage.

15. The insulating building block of claim 14, wherein each of said insulation spaces has a pair of substantially parallel short sides and a pair of substantially parallel long sides extending substantially perpendicular to said short sides of the respective insulating space.

16. The insulating building block of claim 14 wherein said handle passage extends between said insulation spaces of said member.

17. The insulating building block of claim 14 wherein said handle passage is located approximately halfway between said top and bottom faces of said member.

18. The insulating building block of claim 14, wherein said top and bottom faces are substantially parallel to one another, and wherein said front and back faces are substantially parallel to one another and substantially perpendicular to said top and bottom faces.

19. The insulating building block of claim 14, wherein an insulating material substantially fills each of said insulating spaces.

20. The insulating building block of claim 14, wherein said member has two vent spaces, one of said vent spaces being positioned adjacent one of said insulating spaces and the other of said vent spaces being positioned adjacent the other of said insulating spaces.

* * * * *